US007552603B2

(12) United States Patent
Dahlgren

(10) Patent No.: US 7,552,603 B2
(45) Date of Patent: Jun. 30, 2009

(54) CHANNELED MOISTURE MANAGEMENT SOCK

(75) Inventor: Raymond Dahlgren, Tualatin, OR (US)

(73) Assignee: Dahlgren Footwear, Inc., Tualatin, OR (US)

( * ) Notice: Subject to any disclaimer, the term of this patent is extended or adjusted under 35 U.S.C. 154(b) by 0 days.

(21) Appl. No.: 12/142,654

(22) Filed: Jun. 19, 2008

(65) Prior Publication Data

US 2009/0000339 A1 Jan. 1, 2009

Related U.S. Application Data

(60) Provisional application No. 60/945,511, filed on Jun. 21, 2007.

(51) Int. Cl.
*D04B 9/46* (2006.01)

(52) U.S. Cl. ..... 66/185; 2/239

(58) Field of Classification Search ..... 66/182–188; 2/239, 272

See application file for complete search history.

(56) References Cited

U.S. PATENT DOCUMENTS

| | | | |
|---|---|---|---|
| 757,424 | A | 4/1904 | Vohl |
| 1,215,198 | A | 2/1917 | Rothstein |
| 2,144,563 | A | 1/1939 | Davis |
| 2,210,430 | A | 8/1940 | Post |
| 2,242,353 | A | 5/1941 | Gillis |
| 2,651,854 | A | 9/1953 | Taber et al. |
| 2,775,049 | A | 12/1956 | Apteker et al. |
| 2,869,253 | A | 1/1959 | Sachs |
| 2,897,610 | A | 8/1959 | Campagna |
| 3,130,505 | A | 4/1964 | Markevitch |
| 3,250,095 | A | 5/1966 | Bird |
| 3,284,931 | A | 11/1966 | Dassler |
| 3,307,379 | A | 3/1967 | Woolley et al. |
| 3,642,563 | A | 2/1972 | Davis et al. |
| 3,668,793 | A | 6/1972 | Stohr et al. |
| 3,793,851 | A | 2/1974 | Thorneburg |
| 4,172,370 | A | 10/1979 | Safrit et al. |
| 4,194,249 | A | 3/1980 | Thorneburg |
| 4,195,497 | A | 4/1980 | Goldstein |
| 4,232,458 | A | 11/1980 | Bartels |
| 4,255,819 | A | 3/1981 | Klingspor |
| 4,255,949 | A | 3/1981 | Thorneburg |

(Continued)

FOREIGN PATENT DOCUMENTS

| | | |
|---|---|---|
| JP | 60-126357 | 7/1985 |

(Continued)

OTHER PUBLICATIONS

Wignall, H. "Hosiery Technology", United Outer Wear Assoc., 1968, N.Y., N.Y., pp. 63-64.

*Primary Examiner*—Danny Worrell
(74) *Attorney, Agent, or Firm*—Smith-Hill & Bedell, P.C.

(57) ABSTRACT

An improved moisture transfer interface for knit products, such as socks. The interface requires a first knit portion comprising predominately hydrophilic yarn and a second knit portion comprising predominately hydrophobic yarn. The first and second knit portions each possess elongated fingers of their respective yarns which are interlocked with one another. Moisture that is absorbed by the hydrophilic first knit portion is wicked into the hydrophobic second knit portion and subsequently evaporates. The interlocked fingers provide a more effective moisture transfer interface than a non-fingered interface.

16 Claims, 8 Drawing Sheets

U.S. PATENT DOCUMENTS

| | | | | |
|---|---|---|---|---|
| 4,263,793 | A | 4/1981 | Safrit et al. | |
| 4,277,959 | A | 7/1981 | Thorneburg | |
| 4,341,096 | A | 7/1982 | Safrit et al. | |
| 4,373,361 | A | 2/1983 | Thorneburg | |
| 4,377,913 | A | 3/1983 | Stone | |
| 4,430,811 | A | 2/1984 | Okada | |
| 4,438,574 | A | 3/1984 | Johnson | |
| 4,458,429 | A | 7/1984 | Schmid | |
| 4,461,099 | A | 7/1984 | Bailly | |
| 4,464,850 | A | 8/1984 | Ebert et al. | |
| 4,615,188 | A | 10/1986 | Hursh et al. | |
| 4,785,558 | A | 11/1988 | Shiomura | |
| 4,898,007 | A | 2/1990 | Dahlgren | |
| 4,910,887 | A | 3/1990 | Turner et al. | |
| 5,095,548 | A | 3/1992 | Chesebro, Jr. | |
| 5,319,807 | A | 6/1994 | Brier | |
| 5,353,524 | A | 10/1994 | Brier | |
| 5,365,677 | A | 11/1994 | Dalhgren | |
| 5,511,323 | A | 4/1996 | Dahlgren | |
| 5,708,985 | A | 1/1998 | Ogden | |
| 5,724,836 | A | 3/1998 | Green | |
| 6,082,146 | A | 7/2000 | Dahlgren | |
| 6,341,505 | B1 | 1/2002 | Dahlgren | |
| 6,708,348 | B1 * | 3/2004 | Romay | 2/239 |
| 7,069,600 | B1 * | 7/2006 | Romay | 2/239 |

FOREIGN PATENT DOCUMENTS

| | | |
|---|---|---|
| JP | 61-47854 | 3/1986 |

* cited by examiner

TEST RESULTS:
Original Style

| | After 1 Minute | After 5 Minutes | After 10 Minutes | After 30 Minutes |
|---|---|---|---|---|
| Bottom of Foot | 1.6 cm | 4.0 cm | 5.4 cm | 8.7 cm |
| Top of Foot | 2.6 cm | 6.5 cm | 7.0 cm | 8.5 cm |

With Wicking Channels
Vertical Wicking

| | After 1 Minute | After 5 Minutes | After 10 Minutes | After 30 Minutes |
|---|---|---|---|---|
| Bottom of Foot | 4.0 cm | 6.8 cm | 8.0 cm | 10.9 cm |
| Top of Foot | 3.0 cm | 6.7 cm | 8.2 cm | 10.0 cm |

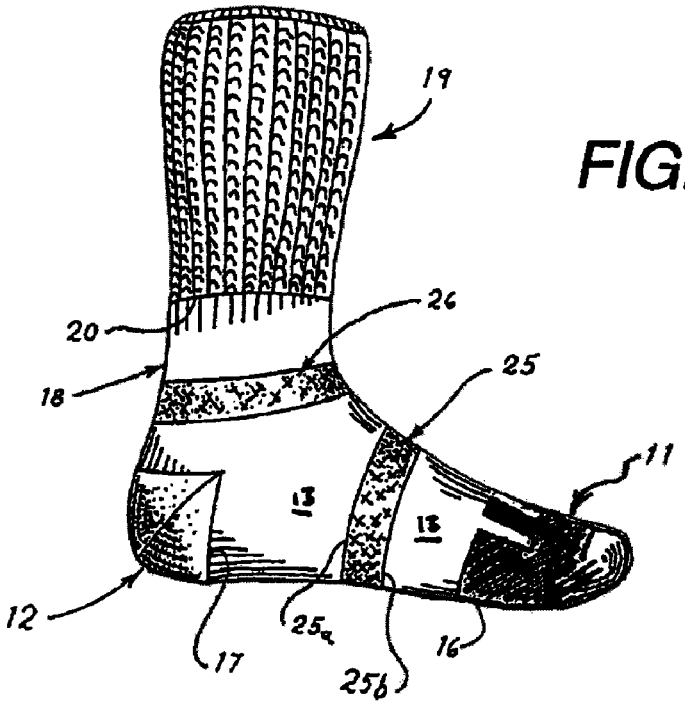
FIG.—5
FIG.—6
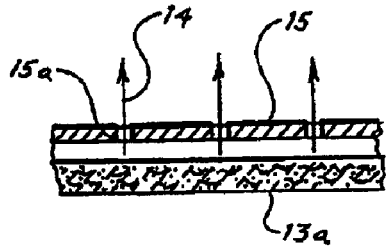
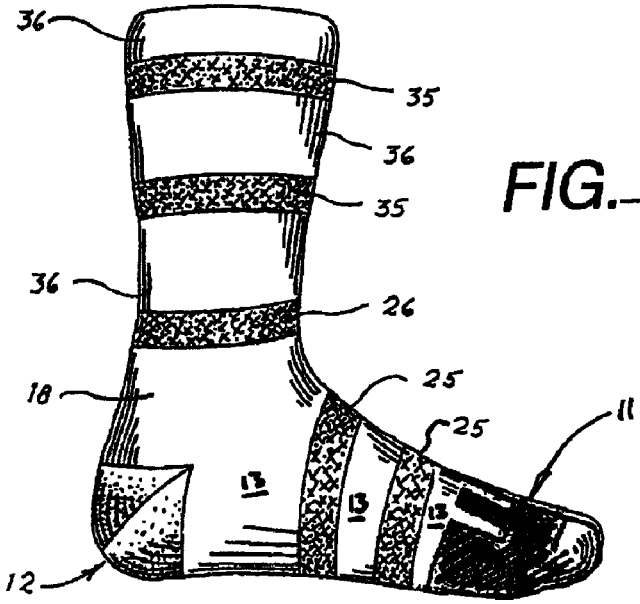
FIG.—7

CHANNELED MOISTURE MANAGEMENT SOCK

RELATED APPLICATION

This application claims priority under 35 U.S.C. §119(e) from U.S. Provisional Patent Application No. 60/945,511, filed Jun. 21, 2007, entitled "Moisture Management Sock with Channels", and incorporated by reference in its entirety.

FIELD OF THE INVENTION

This invention relates generally to all types of socks, and more particularly to an improved sock in which moisture distribution, wicking, and evaporation, are improved by adding alternating channels of hydrophilic and hydrophobic yarns which work to respectively absorb and transfer the moisture absorbed by the hydrophilic toe zone.

BACKGROUND OF THE INVENTION

The moisture that occurs or develops in the foot area is necessary and healthful; however, in excess, it is also uncomfortable. Generally, it has been the practice to rely upon hydrophobic (i.e. non absorbent) yarn worn against the skin to remove moisture away from the skin. Hydrophobic yarns consisting of synthetic resinous material (petroleum based) are non-absorbent, and can result in an uncomfortably wet sock condition underfoot due to impeded air flow and heat retentive characteristics of the yarn. There is need for an improved sock in which moisture collection and disposition are better managed.

SUMMARY OF THE INVENTION

A moisture management sock is provided including a first knit portion and a second knit portion disposed adjacent the first knit portion. The first knit portion is comprised predominately of hydrophilic yarn, and includes a plurality of elongated finger portions spaced-apart from one another and defined by a respective edge. The second knit portion is comprised predominately of hydrophobic yarn, and also includes a plurality of elongated finger portions defined by a respective edge. The second knit finger portions are sized and dimensioned to intermesh with the respective elongated finger portions of the first knit portion such that an improved moisture transfer interface is formed by increasing the surface area contact therebetween. In this manner moisture flow is promoted by wicking action from the first knit portion to the second knit portion.

In one specific embodiment, the moisture transfer interface is generally in the shape of a square wave, having generally linear sides.

Another specific embodiment provides a hydrophobic body yarn that is knit throughout the first knit portion and the second knit portion in a plated relationship with the hydrophilic yarn of the first knit portion and the hydrophobic yarn of the second knit portion. The hydrophobic body yarn comprises stretch nylon, the hydrophilic yarn of the first knit portion comprises cotton, and the hydrophobic yarn of the second knit portion comprises acrylic.

In yet another configuration, the first knit portion comprises a toe portion, and the second knit portion comprises an instep portion. A heel or third knit portion is also provided that is comprised predominately of hydrophilic yarn.

In another embodiment, the heel, instep, and toe portions include lower sections engageable with the bottom of a wearer's foot and wherein the lower sections include terry loops extending inwardly to engage the wearer's foot. An ankle portion may also be included that is adapted to engage a wearer's ankle wherein the ankle portion is knit from material comprising predominately hydrophobic yarn. The moisture is then transferred by wicking action from the heel portion to the ankle portion for evaporation.

Still another specific configuration provides a leg portion connected to the ankle portion and includes alternating bands knit from predominately hydrophobic yarn and bands knit predominately from hydrophilic yarn.

In another aspect of the present invention, an improved garment interface is provided for transferring moisture in a knit yarn product. The garment interface includes a first knit portion comprised predominately of hydrophilic yarn and includes a plurality of elongated finger portions spaced-apart from one another and defined by a respective edge. A second knit portion is comprised predominately of hydrophobic yarn, and includes a plurality of elongated finger portions defined by a respective edge. The corresponding finger portions are sized and dimensioned to intermesh with the respective elongated finger portions of the first knit portion, such that the surface area of an interface contact formed between the respective edge of the first knit portion and the respective edge of the second knit portion in increased. Thus, the transfer of moisture contained in the first knit portion across the garment interface into the second knit portion by wicking action is enhanced.

DRAWING DESCRIPTION

The assembly of the present invention has other objects and features of advantage which will be more readily apparent from the following description of the best mode of carrying out the invention and the appended claims, when taken in conjunction with the accompanying drawing, in which:

FIG. 5 is a side elevation view of an alternative embodiment to the sock assembly of FIG. 1, incorporating moisture absorbent rings.

FIG. 6 is a fragmentary, side elevation view, in cross-section, of a section of a user's sock and shoe, illustrating the directional movement of the moisture from the hydrophilic to hydrophobic yarns in the toe zone.

FIG. 7 is a side elevation view of alternative embodiment to the sock assembly of FIG. 5.

DETAILED DESCRIPTION

Figure 1:
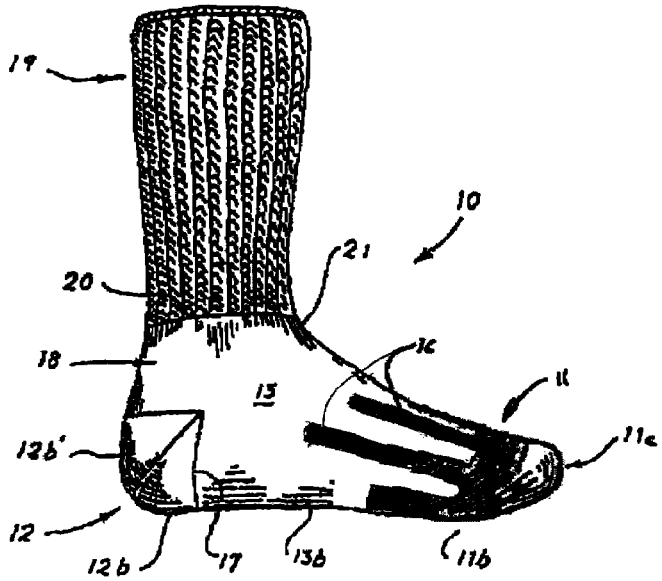
FIG. 1 is a side elevational view showing a sock assembly incorporating an alternating channel design having interlocking finger portions, constructed in accordance with the present invention.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various figures.

Figure 2:
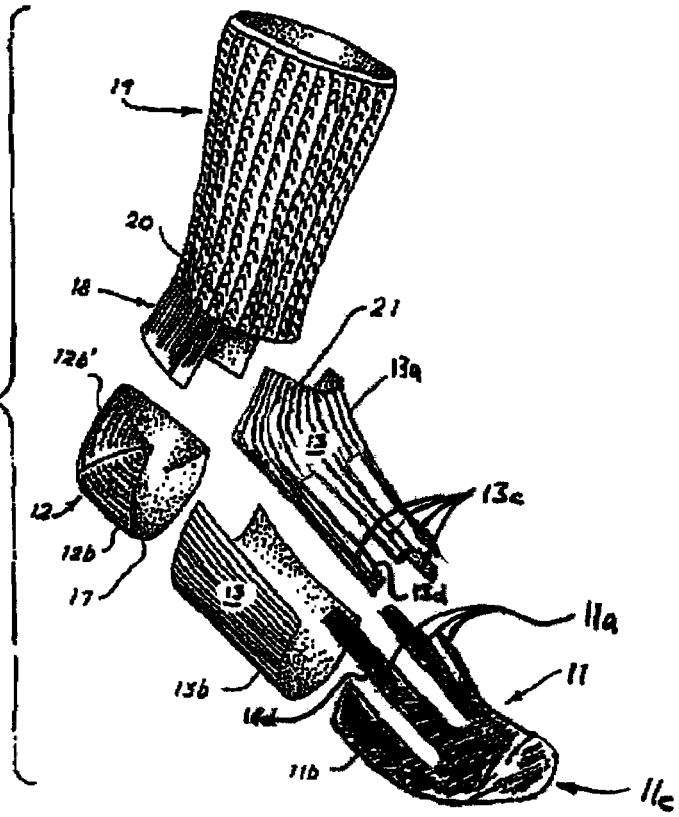
FIG. 2 is an exploded perspective view of the sock assembly of FIG. 1, showing the structure of the toe and instep portion.
Figures 3, 4:
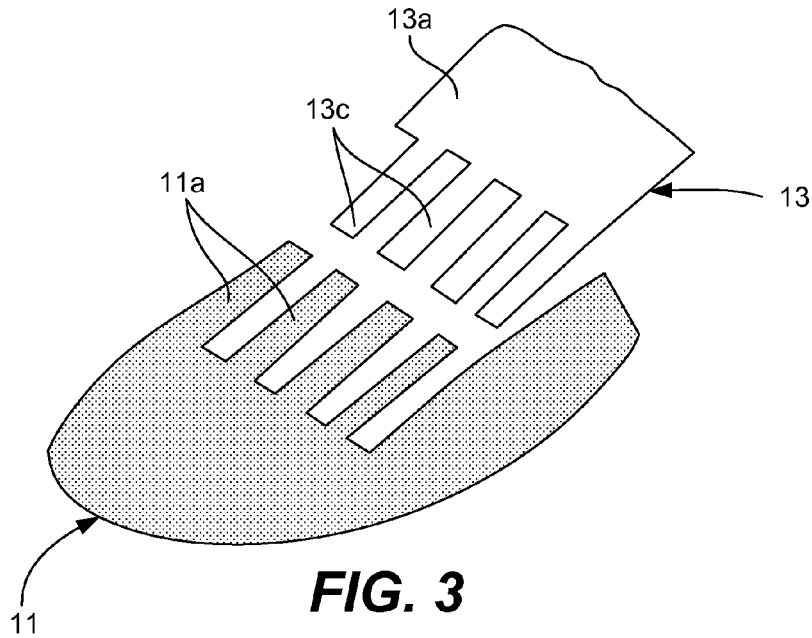
FIG. 3 is an enlarged, exploded perspective view of the toe and instep portion, showing the interlocking finger portions.
FIG. 4 is a table showing improved results.

Referring now to FIGS. 1-3, a moisture management sock, generally designated 10, is provided that includes a first knit portion 11, comprised predominately of hydrophilic yarn, and a second knit portion 13, comprised predominately of hydrophobic yarn. In accordance with the present invention, however, the interfacing edge between the first knit portion 11 and the second knit portion 13 is significantly lengthened, increasing the interfacing contact between the hydrophilic yarn to the hydrophobic yarn. Consequently, increased moisture flow is promoted via wicking action from the hydrophilic yarn to the hydrophobic yarn.

In one specific embodiment, more particularly, the first knit portion 11 includes a plurality of elongated channels or finger portions 11*a* spaced-apart from one another and defined by a respective edge 11*d*. The second knit portion 13 is disposed adjacent the first knit portion 11, and includes a plurality of elongated finger portions 13*c* defined by a respective edge 13*d*. The finger portions 13*c* of the second knit portion are sized and dimensioned to intermesh with the respective elongated finger portions 11*a* of the first knit portion 11 such that an improved moisture transfer interface 16 is formed by increasing the surface contact between the respective edge 11*d* of the elongated finger portions 11*a* of the first knit portion 11 and the respective edge 13*d* of the elongated channels or finger portions 13*c* of the second knit portion 13. By increasing the surface contact at the transfer interface 16, moisture flow is promoted across the interface by wicking action.

The moisture management sock 10 of the present invention, in which foot moisture is managed by the sock knit construction, preferably includes three primary yarn zones: the cup-shaped, and channeled first knit portion 11 at the toe of the sock; a smaller cup-shaped third knit portion 12 at the heel of the sock; and a generally tubular and channeled second knit portion 13 at instep and over the instep.

The channeled first knit portion 11 is predominately comprised of hydrophilic yarn (i.e. characterized as tending to absorb moisture from the toe area of the wearer's foot), particularly at the underside of the wearer's toes which the sock supports and cushions. In accordance with the present invention, at the topside region of the first knit portion 11, the plurality of alternating channel or finger portions 11*a* are disposed which extend generally rearward in a direction from a toe section 11*c* toward a heel or third knit portion 12.

The third knit portion 12, as shown in FIGS. 1 and 2, of the sock 10 is also predominately comprised of hydrophilic yarn (i.e. characterized as tending to absorb moisture from the heel area of the wearer's foot). This is particularly true at the underside portion 12*b* of the wearer's heel which the sock supports and cushions. Third knit portion 12 also distributes moisture to the second knit portion, yet to be described.

The channeled second knit portion 13 at the instep and over the instep of the sock is located between the toe portion 11 and the heel portion 12. Moisture absorbed from heel and toe regions is transferred to the second knit portion, and on to the exterior thereof as by wicking and evaporation (and through vent holes in a surrounding shoe. See for example FIG. 6 showing a section 13*a* of second knit portion 13, and moisture flow paths 14 from section 13*a* through vent holes 15*a* in shoe section 15.). Again, similar to the channeled design of first knit portion 11, the channeled second knit portion 13 includes the plurality of alternating finger or channel portions 13*c* that extend generally forward in a direction from the heel section toward the toe section. These channels are alternately spaced and oriented to mesh and interlock with the channel portions 11*a* of the first knit portion, forming the increased surface area contact interface 16 therebetween. This interlocking channeled design significantly accelerates and improves the amount of moisture drawn from the first knit portion 11 and distributed to the second knit portion 13 by increasing the surface area of the hydrophilic and hydrophobic yarn interface 16, to be described.

As shown, the first knit portion 11 is contiguous and joined edgewise or coursewise to the second knit portion 13 at interface 16 extending about the sock forward of the instep. FIG. 2 best illustrates that the alternating channel portions 11*a*, 13*c* of hydrophilic and hydrophobic yarns work to respectively absorb and transfer the moisture absorbed by the hydrophilic toe zone to the hydrophobic second knit portion 13. As the perspiration and ambient moisture is absorbed by the hydrophilic toe, the hydrophilic channel portions 11*a* continue the absorption at a faster rate due to increased surface area. The adjacent hydrophobic channel portions 13*c* draw the moisture out of the hydrophilic zones. The increased surface area at the interface improves the rate and quantity of moisture moved away from the hydrophobic toe zone.

Figure 8:
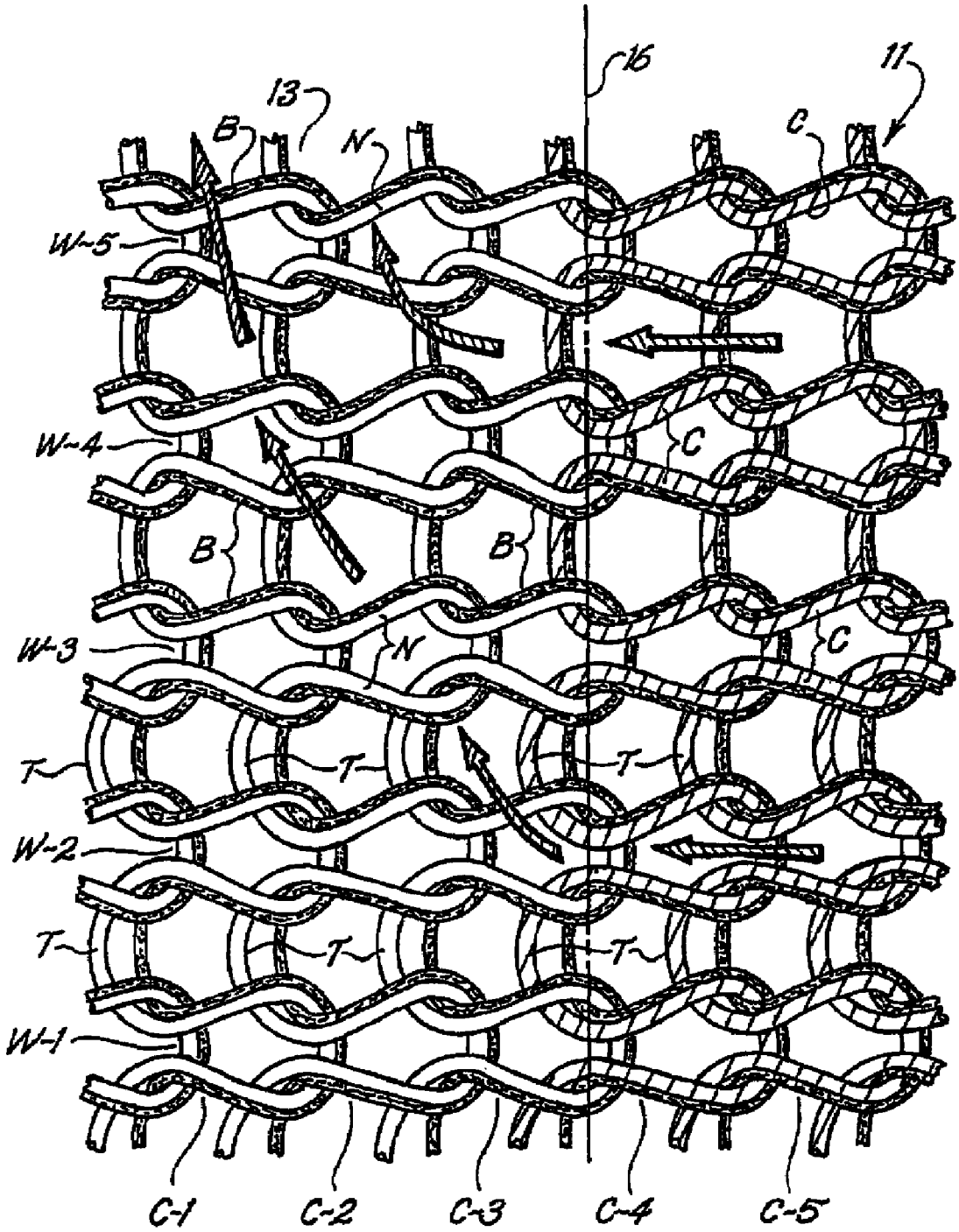
FIG. 8 is a greatly enlarged view of the stitch loop construction in the area of the central portion of the line 16 in FIG. 1.

As mentioned, these channel portions 11*a*, 13*c* are alternately spaced and oriented to mesh and interlock with one another at the contact interface 16 generally between the upper second knit portion 13*a* and the first knit portion 11 (FIGS. 1-3). Upon closer inspection, as shown in FIG. 8, the terry knit loops T of the hydrophilic yarn of the first knit portion 11 are interlocked and intermeshed with the corresponding terry knit loops T the hydrophobic yarn of the second knit portion 13. Such interlocking terry loops is what creates the ability (via wicking action) to flow the moisture across the contact interface 16.

Figure 11A:
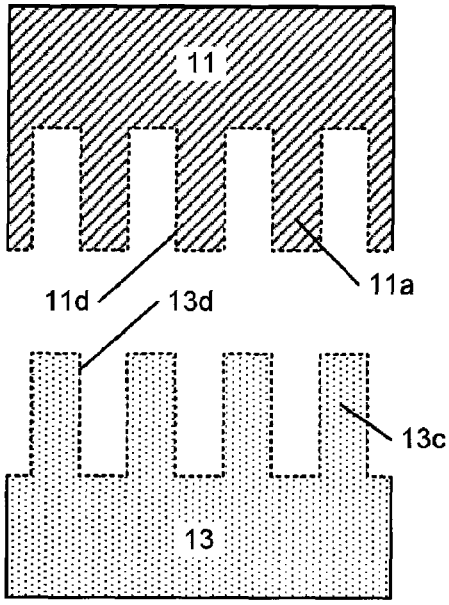
FIG. 11A is a schematic diagram of the first and second knit portions of the sock assembly of FIG. 1, in a disassembled view, illustrating a square-wave pattern of the moisture transfer interface of the interlocking finger portions.
Figure 11B:
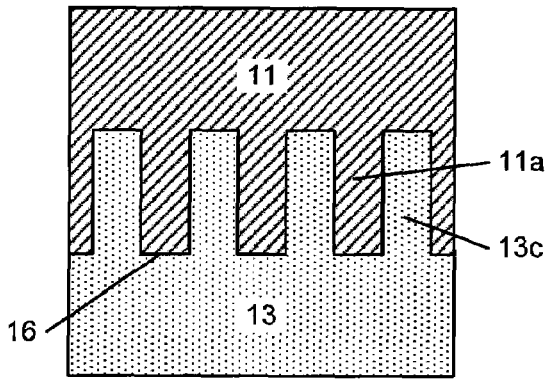
FIG. 11B is a schematic diagram of the interlocking finger portions of FIG. 11A, in an assembled view.

In the preferred form, the intermeshing and alternating channel portions 11*a*, 13*c* are generally rectangular, having substantially linear sides, and extending in directions generally parallel to the longitudinal axis of the sock. Accordingly, the contact interface 16 is generally in the shape of a square-wave. FIGS. 11A-B illustrate a first knit portion 11 and second knit portion 13 featuring square-wave style channels. FIG. 11A depicts an enlarged top plan view of the first knit portion 11 and second knit portion 13, in a disassembled state, that more clearly illustrate respective interface edges 11*d* and 13*d*. FIG. 11B depicts first knit portion 11 and second knit portion 13 in an assembled state so as to more clearly illustrate resulting contact interface 16.

Figure 12A:
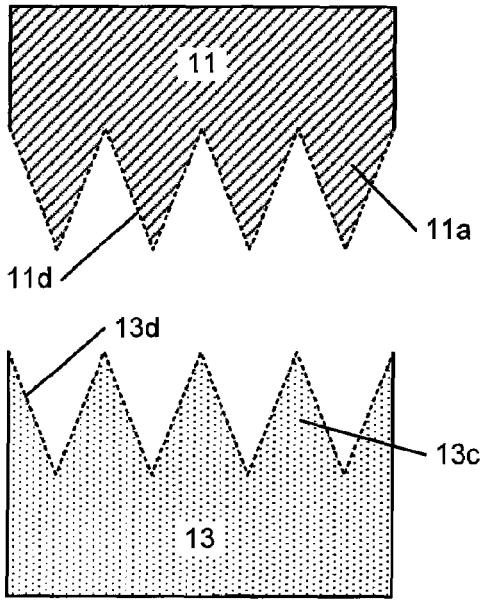
FIG. 12A is a schematic diagram of the first and second knit portions of the sock assembly, in a disassembled view, illustrating an alternative embodiment sawtooth pattern of the moisture transfer interface of the interlocking finger portions.
Figure 12B:
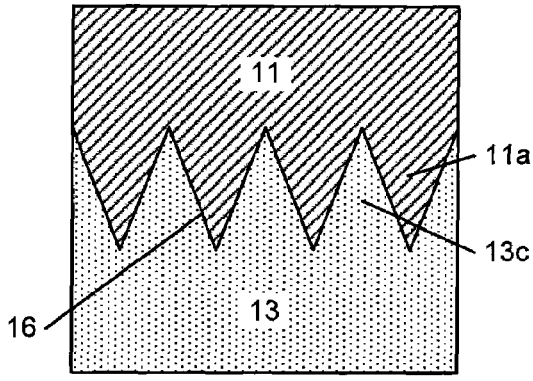
FIG. 12B is a schematic diagram of the sawtooth pattern interlocking finger portions of FIG. 12A, in an assembled view.

It will be appreciated, however, that other finger or channel portion sizes and shapes may be incorporated as long as the surface area of the moisture transfer interface significantly increased, thus promoting enhanced moisture transfer thereacross. By way of example, the finger portions or channels can be of unequal length, as shown in FIGS. 1 and 2. Alternatively, the interfacing edges between the interlocking channel portions may be sawtoothed, which would function to increase the interface surface area contact even more. FIG. 12A and FIG. 12B, for instance, illustrate one implementation of such a sawtooth pattern. FIG. 12A depicts first knit portion 11 and second knit portion 13 in a disassembled state, while FIG. 12B depicts the interlocking first knit portion 11 and second knit portion 13 in an assembled state.

Figure 13A:
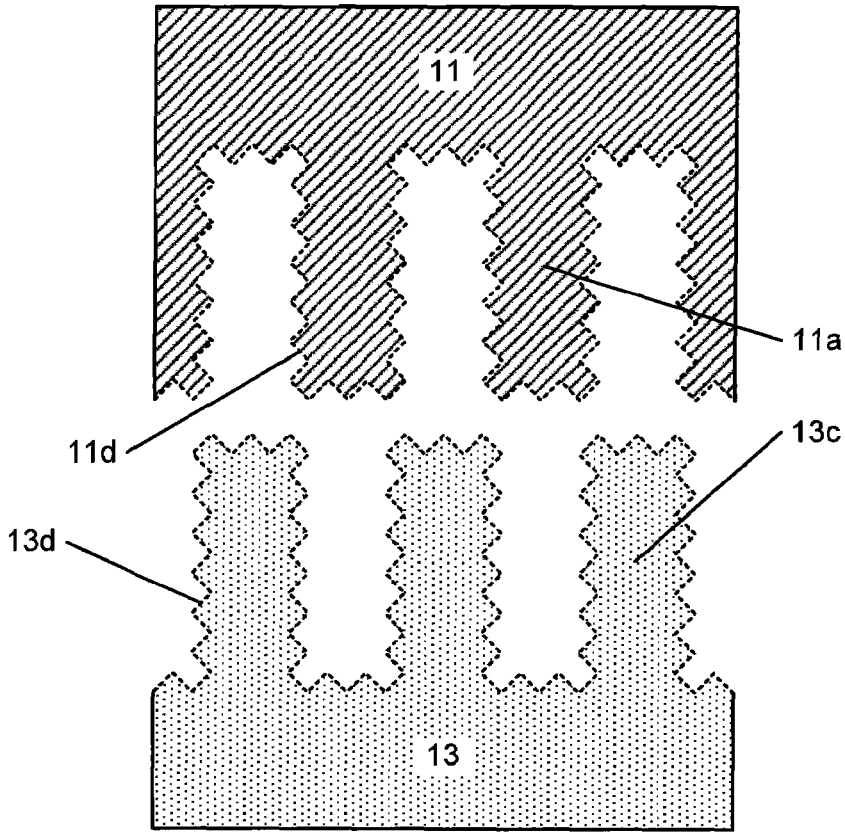
FIG. 13A is a schematic diagram of the first and second knit portions of the sock assembly, in a disassembled view, illustrating a square-wave pattern of the interlocking finger portions having sawtooth pattern edges.
Figure 13B:
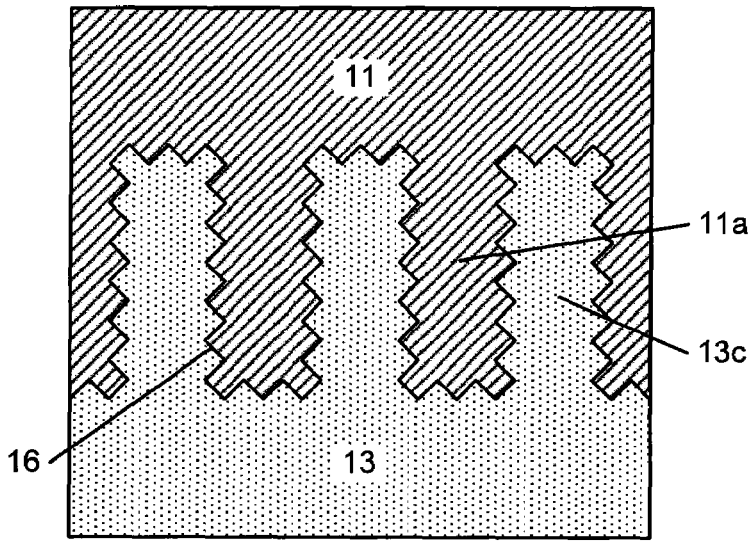
FIG. 13B is a schematic diagram of the sawtooth edge interlocking finger portions of FIG. 13A, in an assembled view

Alternatively, FIGS. 13A and 13B illustrate yet another moisture transfer interface having a square wave pattern with sawtooth pattern edges. FIG. 13A depicts the first knit portion 11 and the second knit portion 13 in the disassembled state, while FIG. 13B represents the interlocking knit portions in an assembled state.

As set forth in the TABLE of FIG. 4, tests have shown that the improvement in moisture absorption between the present inventive channeled design and our previously effective designs to be significant. Such previously effective designs include those of U.S. Pat. Nos. 4,898,007; 5,511,323; 6,082,146 and 6,341,505, all of which are incorporated by reference in their entirety. Such channeled design has improved moisture absorption by as much as about 40%.

In a similar manner, the third knit portion 12 is contiguous and joined edgewise or coursewise to second knit portion 13 at U-shaped interface edge 17. Although the Figures do not depict it to avoid unnecessary complexity in the drawings, it is contemplated that the contact interface between the hydrophilic heel knit portion 12 and the hydrophobic second knit portion 13 can utilize the above-described channel features for enhanced moisture transfer. Yarns at the zones 11-13 have lower sections 11*b*, 12*b*, and 13*b* engagable with the bottom of the wearer's foot, section 12*b*'. Sections 11*b*, 12*b* and 13*b* typically have the form of a cushioned or padded terry knit yarn, for extra comfort.

As shown in the portion of knit fabric of FIG. 8, needle wales W-3, W-4 and W-5 are located in the upper half of the foot and needle wales W-1 and W-2 are located in the lower half or sole of the foot. The portion of the knit fabric in courses C-1, C-2 and C-3 is located in the instep portion of second knit portion 13 and to the left of the edge 16 while the courses C-4 and C-5 are located in the ball portion of the toe first knit portion 11. The entire foot is knit throughout of a hydrophobic binder or body yarn B while additional hydrophilic yarn C (striped in FIG. 8) is knit in plated relationship with the body yarn B in the first and third knit portions 11, 12 (toe and heel portions), and additional hydrophobic yarn N (plain in FIG. 8) is knit in plated relationship with the body yarn B in the second knit portion 13 (instep and sole portion). As shown, terry loops T are formed of the yarns C and N in the sinker wales between the needle wales W-1, W-2 and W-2, W-3.

In either athletic, leisure, or dress type socks, the latter of which this design is particularly suitable for, the hydrophobic body yarn B forms a base or ground fabric and is much smaller than the additional hydrophobic yarn N and the additional hydrophilic yarn C. For example, in an athletic type sock, it is preferred that the body yarn B be a textured stretch nylon of two ply, 100 denier (total of 200 denier), the additional hydrophobic yarn N be an acrylic, such as Creslan, of two ends, 24 single count (equivalent to 443 denier), and the additional hydrophilic yarn C be a 12 single count cotton yarn (equivalent to 443 denier). In this particular example, the amount of the hydrophobic body yarn B is substantially one-half the amount of the hydrophilic yarns C in the first and third knit portions 11, 12 and the hydrophobic yarn N in the second knit portion 13.

Thus, the first and third knit portions 11, 12 (toe and heel portions) are knit predominately of hydrophilic yarn while the second knit portion 13 (instep and sole portion) is knit entirely of hydrophobic yarn. Opposite ends of the second knit portion 13 are joined edgewise or coursewise to the adjacent ends of the corresponding first and third knit portions 11, 12 so that moisture absorbed from the wearer's foot by the predominately hydrophilic yarn C in the first and third knit portions 11, 12 (toe and heel portions) is transferred by wicking action into the predominately hydrophobic yarn N in the second knit portion 13 (instep portion) to be evaporated therefrom, as indicated by the arrows in FIG. 8, showing the path of travel of the moisture from the first knit portion (toe) 11 to the second knit portion (instep) 13. As shown in FIG. 1, the toe portion 11 also includes an adjacent portion of the foot of the sock which is adapted to engage and underlie the ball of the wearer's foot. This ball portion is also knit predominately of the hydrophilic yarn C.

While the hydrophobic body yarn B is knit throughout the sock, for the purpose of providing sufficient stretch to the sock to fit a range of foot sizes, it is to be understood that the sock can be knit without a body yarn. In this instance, the first knit portion (toe) 11 and the third knit portion (heel) 12 will be knit entirely of hydrophilic yarn C and the second knit portion (instep) 13 will be knit entirely of the hydrophobic yarn N. Thus, when the first knit portion (toe) 11 and the third knit portion (heel) 12 are described as being knit predominately of the hydrophilic yarn, this is intended to also mean that these zones can be knit entirely of the hydrophilic yarn as indicated in the TABLE A below where the first and third knit portions 11 and 12 are indicated as being knit of 100% hydrophilic yarn and the second and fourth knit portions 13 and 18 (to be described below) are indicated as being knit of 100% Nylon or Creslan (hydrophobic) yarn.

In one specific embodiment, the moisture management sock 10 may also include a fourth knit portion 18 which is generally tubular and extends about the foot at ankle level, above the heel or third knit portion 12, and wherein the yarn is predominately hydrophobic, and typically merges with the yarn of instep second knit portion 13 at region 21. This fourth knit portion 18 tends to wick moisture upwardly away from the upper part of heel or third knit portion 12 and to transfer such moisture to the exterior as by evaporation just above shoe level, at the ankle region. FIGS. 1 and 2 also show a sock upper tubular and cushioned portion 19 to fit about the wearer's lower leg, and which also consists of hydrophobic yarn, merging with the fourth knit portion 18, at edge 20.

The yarn at all three knit portions 11, 12 and 13, and also at the fourth knit portion 18, is knit in plated relationship with the synthetic resin binder or body yarn to enhance fit and to serve as a backing for terry knit; and the yarn at the first and third (hydrophilic) knit portions 11 and 12 typically includes cotton or wool in an amount between 50 and 100 percent of the total yarn at the first and second knit portions 11 and 12. Other applicable hydrophilic yarns include alpaca, alpaca blended with merino, cotton, silk, etc. Typically, there is little or no cotton yarn at the second and fourth knit portions 13 and 18. The cotton yarn is knit with the synthetic resin binder or body yarn at the first and third knit portions 11 and 12, using conventional knitting machines and plating processes, and most desirably, the amount of hydrophilic yarn is about 75 percent of the total yarn at these knit portions 11 and 12.

The synthetic resin binder or body yarn at all zones most desirably includes resiliently stretchable Nylon, or equivalent; and the synthetic resin yarn at zones 13 and 18 most desirably includes Acrylic yarn, DriRelease, polyester or equivalent, in amounts substantially greater than the Nylon yarn at the second and fourth knit portions 13 and 18.

The following TABLE A shows the yarn proportions:

TABLE A

| Portions or Regions | Yarn | Range (%) | Preferred (%) Athletic | Preferred (%) Dress |
|---|---|---|---|---|
| 11 & 12 | Hydrophilic | 50-100 | 75 | 100 |
| 13 | Nylon | 50-0 | 25 | 0 |
| | Hydrophobic | 50-100 | 75 | 100 |
| 18 | Nylon | 50-0 | 25 | 0 |
| | Hydrophobic | 50-100 | 90 | 100 |

As set forth above, the Nylon binder or body yarn is a resiliently stretchable, i.e. elastic, yarn, whereby the sock will stretch to closely fit a wide range of foot sizes. If the sock is not to be stretchable, Nylon binder or body yarn may be omitted, i.e. all synthetic yarn may consist of Creslan, or equivalent.

Figure 9:
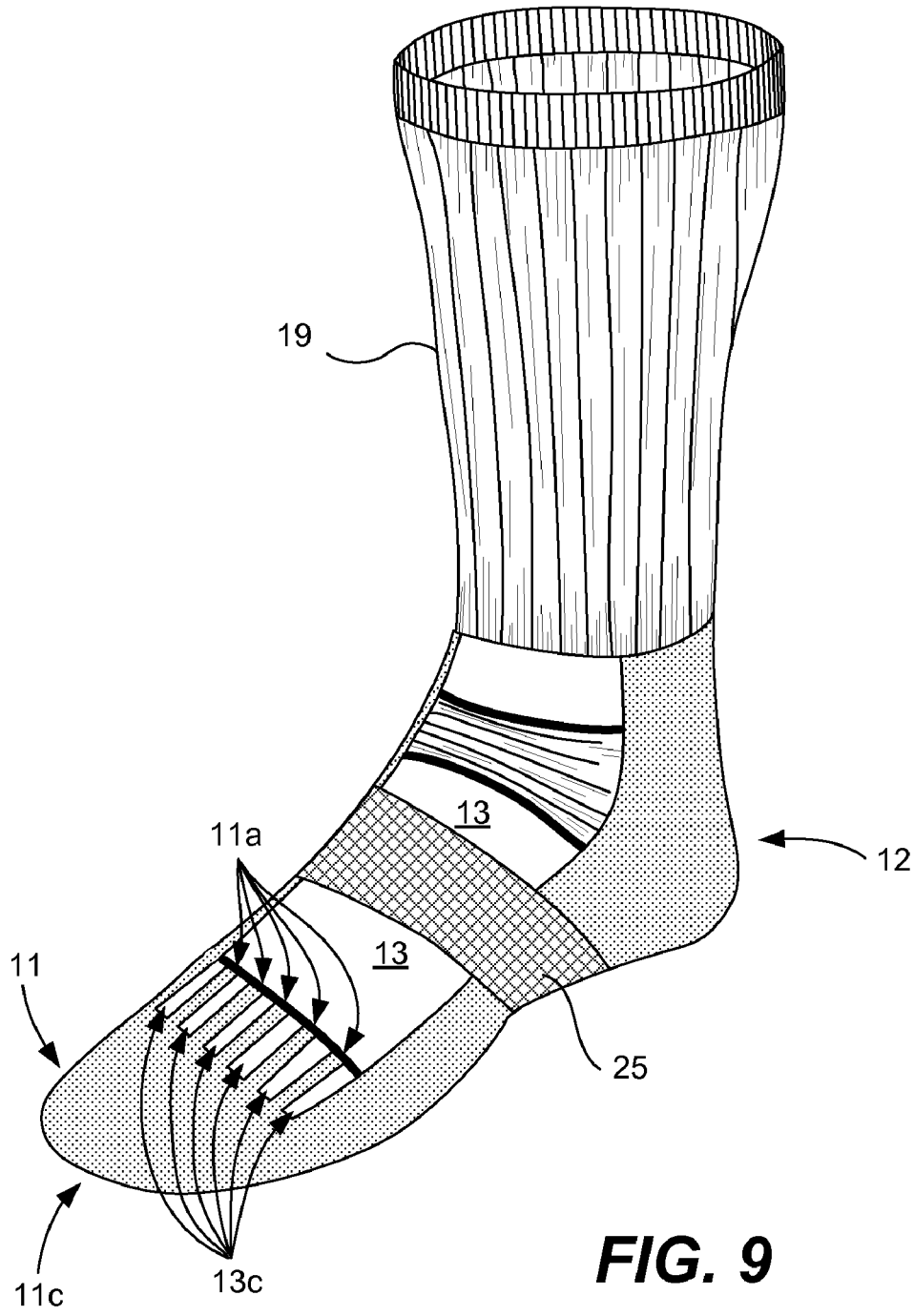
FIG. 9 is a top perspective view of another alternative embodiment to the sock assembly of FIG. 1, incorporating moisture absorbent rings.
Figure 10:
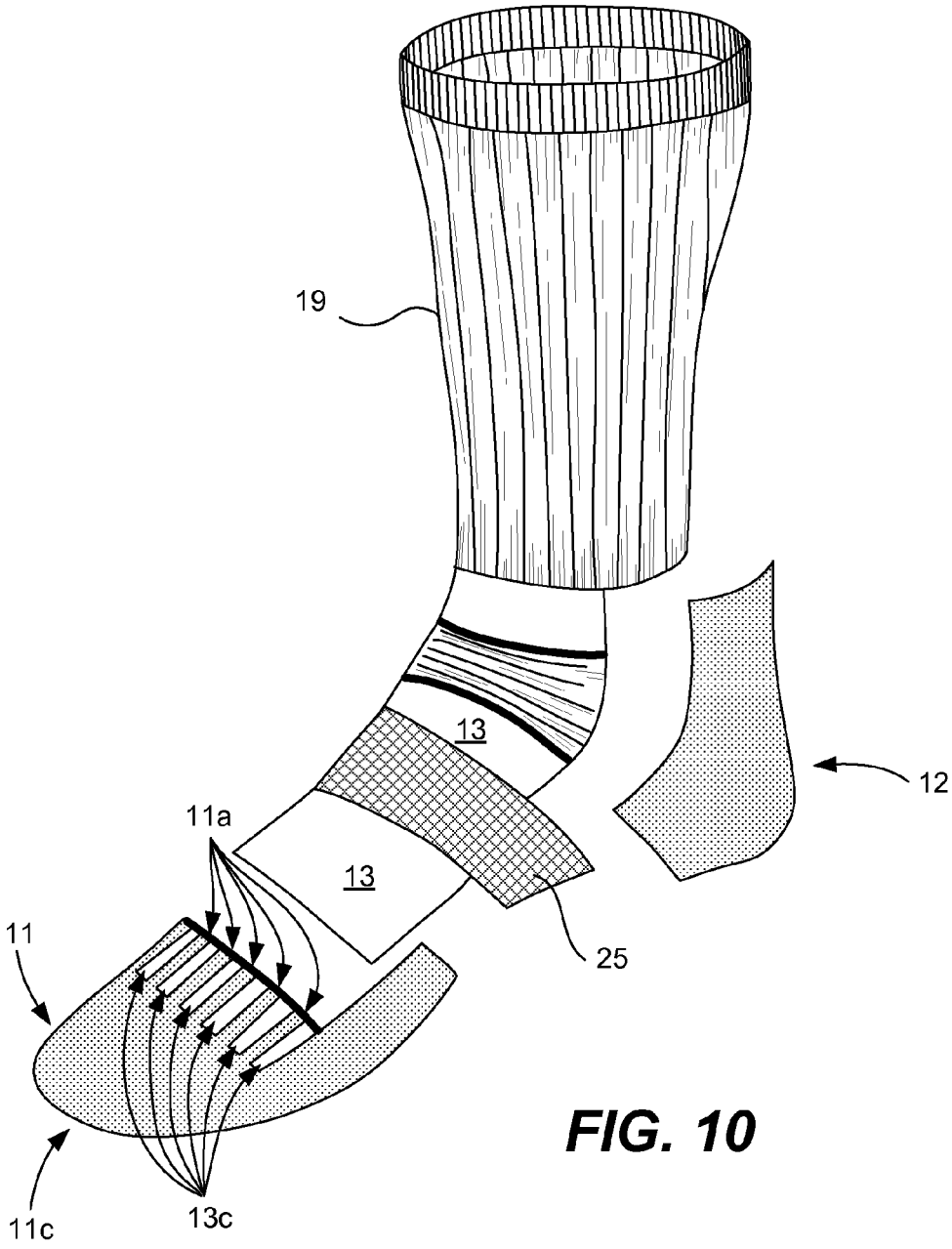
FIG. 10 is an exploded perspective view of the alternative embodiment sock assembly of FIG. 9.

Referring now to FIGS. 5, 9 and 10, another specific embodiment of the moisture management sock 10 is illustrated which incorporate either or both of a fifth and sixth knit portions 25 and 26. The composition of both the fifth knit portion 25 and the sixth knit portion 26 is predominately hydrophilic, and is substantially the same as that of the first and third knit portions, as set forth in the above TABLE A. The fifth and sixth knit portions 25 and 26 further enhance the moisture management effect, i.e. they collect moisture and transfer it, via wicking action to the second and fourth knit portions 13 and 18, for better transfer to the exterior—i.e. away from the sock and foot at their respective interface edges (e.g., interface edges 25*a* and 25*b* in FIG. 6).

The fifth knit portion 25 is spaced from and between the first and third knit portions 11 and 12, and extends about the wearer's foot in a loop or tube shape. As shown, the second knit portion 13 extends between the fifth knit portion 25 and the first and third knit portions 11 and 12. The sixth knit portion 26, on the other hand, is oriented above the wearer's ankle region with the material of the fourth knit portion 18 extending above and below the sixth knit portion 26, as shown.

FIG. 7 illustrates yet another specific embodiment of the moisture management sock 10, typically for use in a boot on the wearer's foot. In this configuration, alternating hydrophilic bands 35 and hydrophobic bands 36 are provided, in addition to the structure as described previously, which cooperate to transfer moisture up the wearer's ankle.

I claim:

1. An improved garment interface for transferring moisture in a knit yarn product, the garment interface comprising:

a first knit portion having a general first knit length and a general first knit width, and comprised predominately of hydrophilic yarn, said first knit portion including a plurality of elongated finger portions spaced-apart from one another and each having a general finger length and a general finger width of significant dimension relative to the first knit length and first knit width of the first knit portion, said elongated finger portions defined by a respective edge; and a second knit portion having a general second knit length and a general second knit width, and comprised predominately of hydrophobic yarn, said second knit portion including a plurality of elongated finger portions each having a general finger length and a general finger width of significant dimension relative to the second knit length and second knit width of the second knit portion, said elongated finger portions defined by a respective edge, and sized and dimensioned to intermesh with the respective elongated finger portions of the first knit portion, such that the surface area of an interface contact formed between the respective edge of the first knit portion and the respective edge of the second knit portion is significantly increased, and wherein moisture contained in the first knit portion is transferred across the garment interface into the second knit portion by wicking action.

2. The garment interface according to claim 1, wherein a hydrophobic body yarn is knit throughout the first knit portion and the second knit portion in a plated relationship with the hydrophilic yarn of the first knit portion and the hydrophobic yarn of the second knit portion.

3. The garment interface according to claim 2, wherein the hydrophobic body yarn comprises stretch nylon, the hydrophilic yarn of the first knit portion comprises cotton, and the hydrophobic yarn of the second knit portion comprises acrylic.

4. The garment interface according to claim 1, wherein the respective edge of the elongated finger portions of the first knit portion define a sawtooth pattern, and wherein the respective edge of the elongated finger portions of the second knit portion define a sawtooth pattern that intermeshes with the respective sawtooth pattern on the respective edge of the elongated finger portions of the first knit portion.

5. The garment interface according to claim 1, wherein the garment interface is generally in the shape of an elongated square wave.

6. A moisture management sock comprising:

a first knit portion having a general first knit length and a general first knit width, and comprised predominately of hydrophilic yarn, the first knit portion including a plurality of elongated finger portions spaced-apart from one another and each having a general finger length and a general finger width of significant dimension relative to the first knit length and first knit width of the first knit portion, said elongated finger portions defined by a respective edge; and a second knit portion, disposed adjacent the first knit portion, having a general second knit length and a general second knit width, and comprised predominately of hydrophobic yarn, the second knit portion including a plurality of elongated finger portions each having a general finger length and a general finger width of significant dimension relative to the second knit length and second knit width of the second knit portion. said elongated finger portions defined by a respective edge, and sized and dimensioned to intermesh with the respective elongated finger portions of the first knit portion such that an improved moisture transfer interface is formed by significantly increasing the surface area contact between the respective edge of the elongated finger portions of the first knit portion and the respective edge of the elongated finger portions of the second knit portion, and such that moisture flow is promoted by wicking action from the first knit portion to the second knit portion.

7. The moisture management sock of claim 6, wherein the respective edge of the elongated finger portions of the first knit portion define a sawtooth pattern, and wherein the respective edge of the elongated finger portions of the second knit portion define a sawtooth pattern that intermeshes with the respect sawtooth pattern on the respective edge of the elongated finger portions of the first knit portion.

8. The moisture management sock of claim 6, wherein a hydrophobic body yarn is knit throughout the first knit portion and the second knit portion in a plated relationship with the hydrophilic yarn of the first knit portion and the hydrophobic yarn of the second knit portion.

9. The moisture management sock of claim 6, wherein the first knit portion comprises a toe portion, and the second knit portion comprises an instep portion.

10. The moisture management sock of claim 9, further including a heel portion comprised predominately of hydrophilic yarn.

11. The moisture management sock of claim 9, wherein the heel, instep, and toe portions include lower sections engageable with the bottom of a wearer's foot and wherein the lower sections include terry loops extending inwardly to engage the wearer's foot.

12. The moisture management sock of claim 9, further including an ankle portion adapted to engage a wearer's ankle wherein the ankle portion is knit from material comprising predominately hydrophobic yarn, and whereby moisture is transferred by wicking action from the heel portion to the ankle portion for evaporation.

13. The moisture management sock of claim 9, wherein the toe portion engages the ball of a wearer's foot in addition to the wearer's toes.

14. The moisture management sock of claim 8, wherein the hydrophobic body yarn comprises stretch nylon, the hydrophilic yarn of the first knit portion comprises cotton, and the hydrophobic yarn of the second knit portion comprises acrylic.

15. The moisture management sock of claim 12, further including a leg portion connected to the ankle portion and comprising alternating bands knit from predominately hydrophobic yarn and bands knit predominately from hydrophilic yarn.

16. The moisture management sock of claim 6, wherein the moisture transfer interface is generally in the shape of an elongated square wave.

* * * * *